US006168378B1

(12) United States Patent
Craw et al.

(10) Patent No.: US 6,168,378 B1
(45) Date of Patent: Jan. 2, 2001

(54) AIR DEFLECTORS TO ACCOMMODATE MULTIPLE SIZE VENTILATOR OUTLETS

(75) Inventors: Gary J. Craw, Delafield; Daniel L. Karst, Beaver Dam, both of WI (US)

(73) Assignee: Broan-Nutone LLC, Hartford, WI (US)

( * ) Notice: Under 35 U.S.C. 154(b), the term of this patent shall be extended for 0 days.

(21) Appl. No.: 09/371,286

(22) Filed: Aug. 10, 1999

(51) Int. Cl.[7] ..... F04D 29/44

(52) U.S. Cl. ..... 415/211.2; 415/212.1; 415/214.1

(58) Field of Search ..... 415/203, 204, 415/206, 211.2, 213.1, 214.1, 212.1, 902

(56) References Cited

U.S. PATENT DOCUMENTS 1,663,998 * 3/1928 Schmidt ..... 415/204
2,282,015 * 5/1942 Williams ..... 62/262
3,020,829 * 2/1962 Pearson ..... 415/212.1
3,874,191 * 4/1975 Hudson ..... 415/206

* cited by examiner

*Primary Examiner*—Edward K. Look
*Assistant Examiner*—Ninh Nguyen
(74) *Attorney, Agent, or Firm*—Andrus, Sceales, Starke & Sawall,

(57) ABSTRACT

A pair of air deflectors attached to the outlet opening of a blower assembly housed within a ventilator housing to accommodate multiple size outlets in the ventilator housing of a ventilation system. The air deflectors include a front portion for attachment to a sidewall flange extending outwardly from the outlet opening of the blower assembly, a transition portion extending rearwardly and inwardly from one side of the front portion, and a flange extending rearwardly from the transition portion for attachment to a sidewall of the blower assembly. The air deflectors attached to the outlet opening of the blower assembly increase air flow, decrease air turbulence and decrease noise within the ventilation system.

11 Claims, 4 Drawing Sheets

AIR DEFLECTORS TO ACCOMMODATE MULTIPLE SIZE VENTILATOR OUTLETS

BACKGROUND OF THE INVENTION

The present invention relates to ventilators used in building ventilation systems, and more particularly to air deflectors for use with such ventilators.

Ventilation systems are used to control the temperature and air quality in buildings. These ventilation systems include a number of exhaust ventilators spaced throughout the building to withdraw air from the rooms in the building. Removal of air from the rooms allows a separate heating and/or air conditioning system in the building to supply air to the rooms to effectively control the temperature within the building.

The ventilators connected to the ventilation system are normally located directly above the ceiling of the room so that the ventilator can withdraw air from the room by means of a fan or blower mounted in the ventilator. After the air is drawn into the ventilator by the blower, the air is then discharged from the ventilator by the blower through an outlet opening in the ventilator housing. The outlet opening is connected to a ventilation duct that extends throughout the building. The ventilation duct leads from the ventilator to the exterior of the building, allowing the air removed by the ventilator to be vented to the outside atmosphere.

The ventilator typically includes a blower assembly housed within a ventilator housing. The blower assembly comprises a scroll cage with air inlet openings on the sides thereof, and an air outlet opening at one end of the scroll cage. The scroll cage includes a blower wheel mounted therein and driven by an electric motor. The ventilator housing includes an outlet opening which is designed to mate with the outlet opening of the blower assembly.

Prior art ventilator housings are generally made with different sized outlet openings which may or may not be the same size as the outlet openings of the blower assembly housed therein. A ventilator housing having a smaller sized outlet opening than the blower assembly outlet opening causes a decrease in air flow and an increase in air turbulence, making the ventilation system very noisy and inefficient. In addition, it is desirable to use a common blower assembly in different ventilation housings to reduce the number of parts and production costs involved in manufacturing the ventilation systems. A larger, wider blower wheel that spins slower and moves a larger amount of air reduces vibration and noise within the system. Therefore, there is a need for a ventilation system that is quieter and more efficient than prior art systems.

To satisfy this need, a pair of air deflectors have been designed for attachment to the outlet opening of a blower assembly to act as a transition between the outlet opening of the blower assembly and the outlet opening of the ventilator housing to increase air flow, decrease air turbulence and decrease noise in the ventilation system.

SUMMARY OF THE INVENTION

The present invention provides a pair of air deflectors which are attached to the outlet opening of a blower assembly housed within a ventilator housing to accommodate multiple size outlets in the ventilator housing. The air deflectors are formed of a single piece of rigid material, such as metal. The air deflectors each include a front portion which attaches to a sidewall flange extending outwardly from the outlet opening of the blower assembly, a transition portion extending rearwardly and at an angle from the front portion, and a flange extending rearwardly from the transition portion which attaches to a sidewall of the blower assembly.

The air deflectors are comprised of a right side air deflector that is attached to the right side of the blower assembly outlet opening and a left side air deflector that is attached to the left side of the blower assembly outlet opening. The right and left side air deflectors are mirror images of each other. Each deflector has a front portion, a transition portion extending rearwardly and at an angle from the front portion, and a flange extending rearwardly from the transition portion. The front portion of each air deflector includes a hole extending therethrough for attaching the outlet opening of the blower assembly to the outlet opening of the ventilator housing with fasteners and the like.

The air deflectors are fixedly attached to each side of the blower assembly's outlet opening to decrease the width of the outlet opening and to provide a smooth transition for air flow from the blower assembly through the ventilator housing and into a ventilation duct attached to the ventilator housing.

Various other features, objects and advantages of the invention will be made apparent to those skilled in the art from the following drawings and detailed description of the invention.

DETAILED DESCRIPTION OF THE INVENTION

Figure 2:
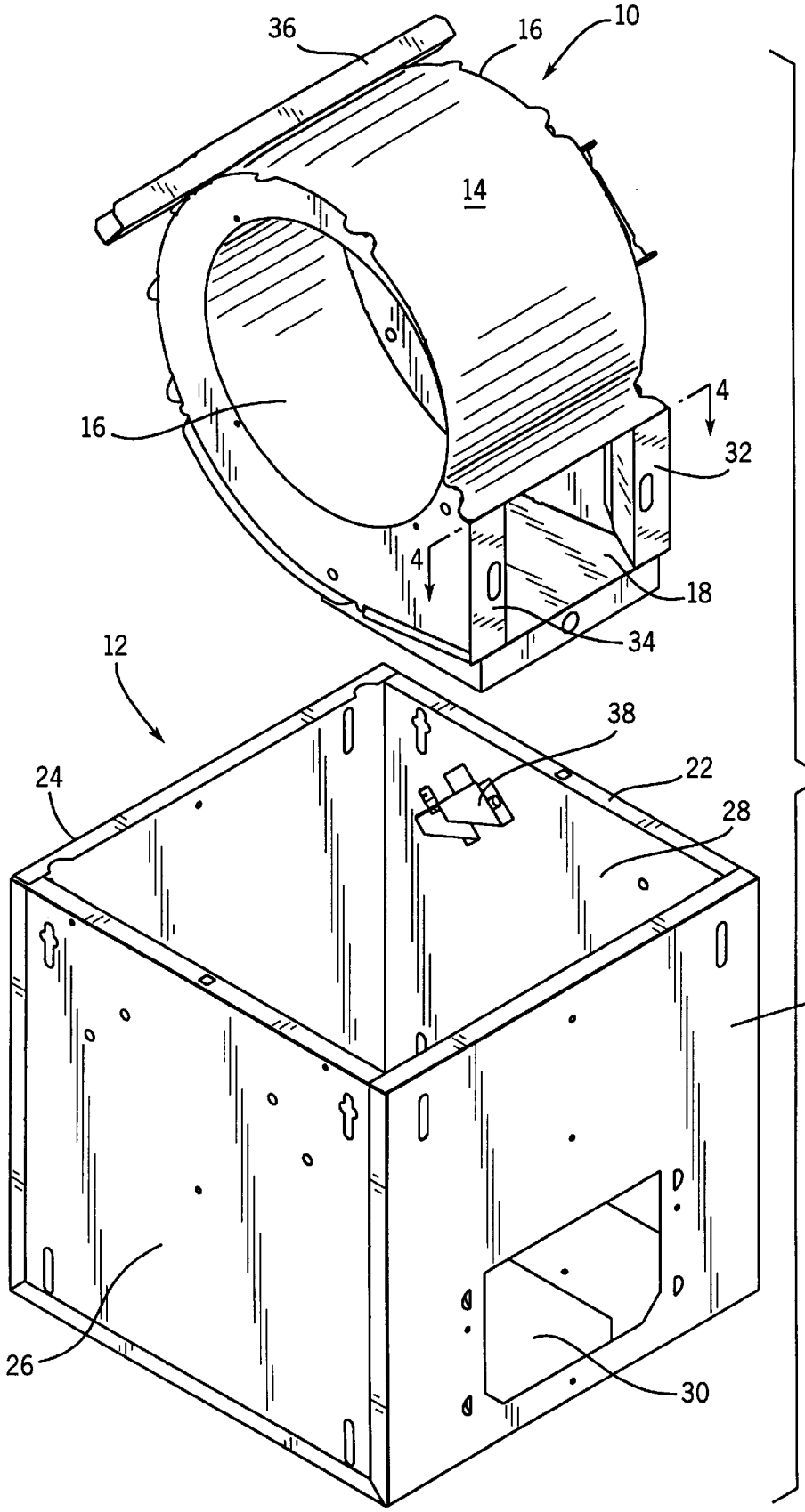
FIG. 2 is an exploded perspective view of the blower assembly and ventilator housing of FIG. 1.

FIG. 2 illustrates a blower assembly 10 and a ventilator housing 12 of a ventilator for use in controlling the temperature and air quality within a building. For ease of illustration, the blower assembly and ventilator housing are shown inverted from their position of customary use in the ceiling of a building. The blower assembly 10 comprises a scroll cage 14 with circular air inlet openings 16 on each side thereof and a rectangularly shaped outlet opening 18 at one end of the scroll cage 14. The scroll cage 14 houses a blower wheel (not shown) driven by an electric motor (not shown) for moving air through a ventilation system.

The ventilator housing 12 is typically installed in a ceiling or wall of a room of a building. The ventilator housing 12 comprises a box-like structure having four sidewalls 20, 22, 24 and 26. The ventilator housing 12 also includes an open end 28 which forms the lower end of housing 12 when the ventilator is in use. A grill (not shown) located in the ceiling or wall of a room to be ventilated is attached to end 28. The ventilator housing 12 also includes an outlet opening 30 in sidewall 20 for connection to a ventilation duct (not shown) that leads from the ventilator housing to the exterior of the building. Outlet opening 18 of scroll cage 14 is larger than outlet opening 30 in ventilator housing 12.

Attached to the right and left sides of the outlet opening 18 of the scroll cage 14 are right and left side air deflectors 32, 34 respectively. The air deflectors 32, 34 decrease the width of the outlet opening 18 to match the width of ventilator housing outlet opening 30. The air deflectors 32, 34 provide a smooth transition for air moving from the blower assembly 10 through the ventilator housing outlet opening 30 and into a ventilator duct (not shown) connected to the ventilator housing 12.

Figure 1:
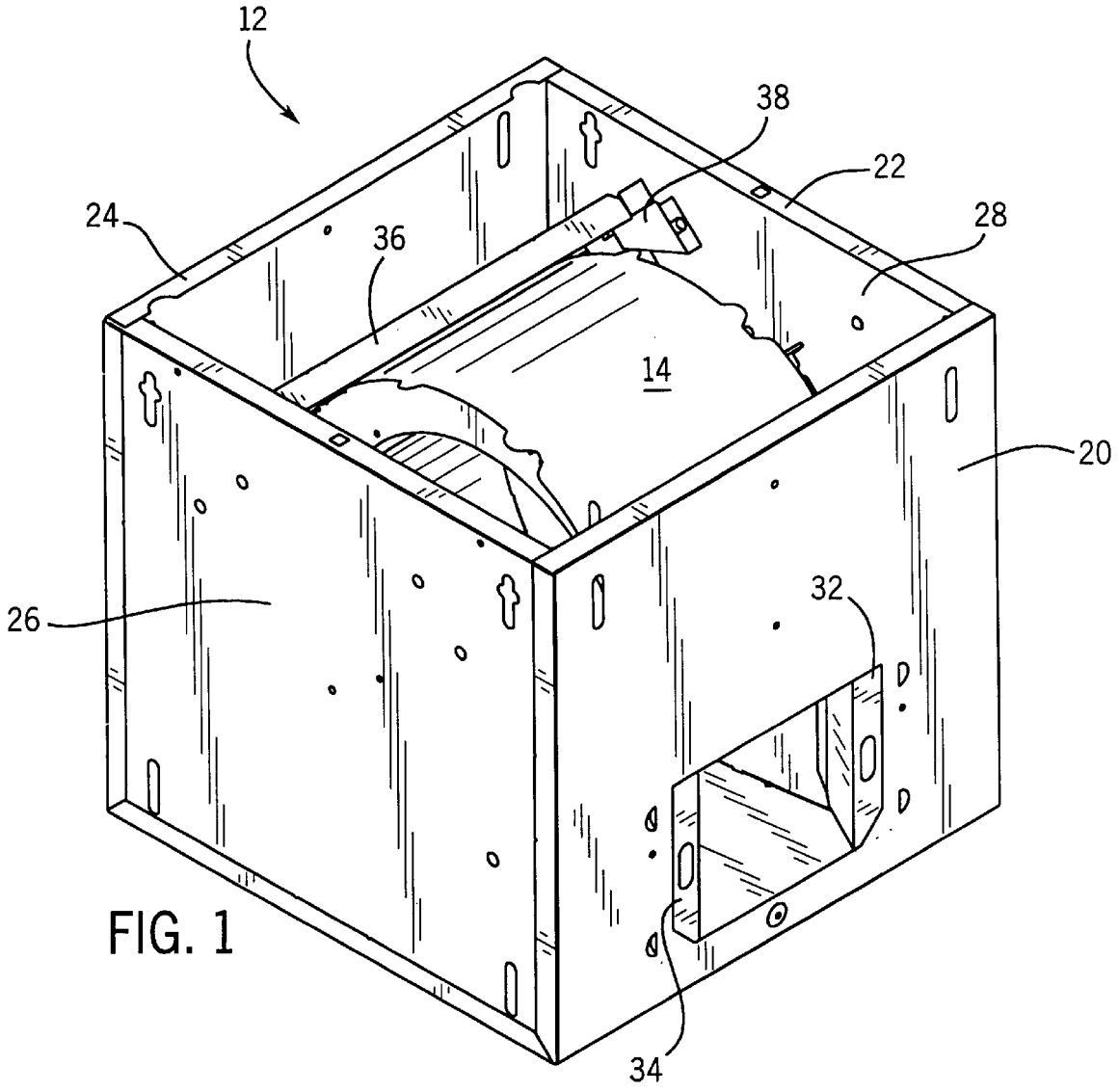
FIG. 1 is a perspective view of a ventilator including a blower assembly installed within a ventilator housing.

FIG. 1 shows the scroll cage 14 of the blower assembly 10 installed in the ventilator housing 12. The scroll cage 14 is inserted through the open end 28 of the ventilator housing 12. A mounting bar 36 attached to the outside surface of the scroll cage 14 is fastened to a pair of mounting brackets 38 (only one shown) attached to the inside surface of sidewalls 22 and 26 for securing the scroll cage 14 in the ventilator housing 12. As is shown in FIG. 1, the outlet opening 18 of the blower assembly 10 containing air deflectors 32, 34 coincides within the outlet opening 30 of the ventilator housing 12. The smooth transition provided by air deflectors 32, 34 between outlet opening 18 and outlet opening 30 increases air flow and decreases air turbulence in the ventilation system by reducing the width of the blower assembly outlet opening 18 to match the width of the ventilator housing outlet opening 30.

For example, the air deflectors may decrease the width of the blower assembly outlet opening from 8 inches to 6 inches to accommodate a 6 inch wide opening in the ventilator housing. Under normal conditions, air exiting a blower assembly with an 8 inch wide opening would hit the flat sidewall of a ventilator housing having a 6 inch wide opening, causing reduced air flow and turbulent air flow.

The use of air deflectors 32, 34 allows the use of a common blower assembly for different sized ventilator housing outlets, thereby reducing the number of components and decreasing the assembly time of the ventilators. That is, a blower assembly having an 8 inch wide opening can be used without the air deflectors with a ventilator housing having an 8 inch wide opening and with the air deflectors for a ventilator housing having a 6 inch wide opening.

Figure 3:
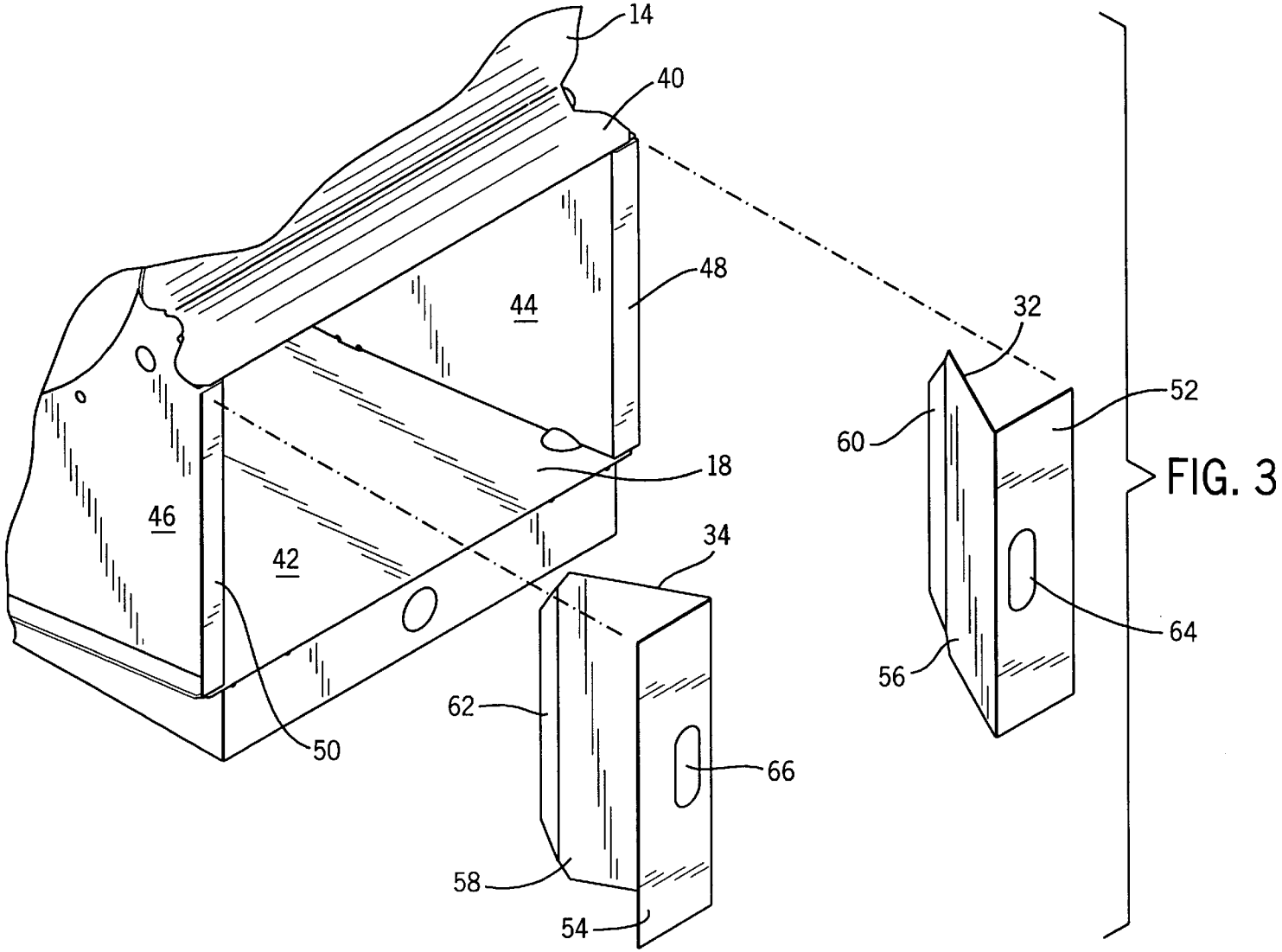
FIG. 3 is an exploded perspective view of a blower assembly outlet opening and a pair of air deflectors of the present invention.

FIG. 3 shows an enlarged view of the blower assembly outlet opening 18 and the air deflectors 32, 34 which are attachable to the sides of the outlet opening 18. The scroll cage 14 includes an outlet opening 18 having a wall 40 opposing wall 42, a right sidewall 44 and a left sidewall 46 when viewed as in FIG. 3. The sidewalls 44 and 46 each have flanges 48 and 50 extending outwardly therefrom at the outlet opening 18 to form a front face for attachment of the air deflectors 32, 34 to the sides of the outlet opening 18. The flanges 48, 50 extend outwardly from the sidewalls 44, 46 at approximately right angles thereto.

The right side air deflector 32 and the left side air deflector 34 are attached to the right and left sidewalls 44 and 46 of the outlet opening 18 respectively. The right 32 and left 34 air deflectors may be identical in construction. The right and left side air deflectors 32, 34 each comprise a front portion 52, 54 which are attached to the sidewall flanges 48 and 50. The front portions 52, 54 are preferably welded to the sidewall flanges 48, 50, but may be attached by other means such as an adhesive or fasteners and the like. Extending rearwardly and inwardly from one side of each front portion 52, 54 is a transition portion 56, 58. The transition portions 56, 58 extend inwardly from one side of the front portions 52, 54 at an acute angle thereto. Extending rearwardly from the transition portions 56, 58 are flanges 60, 62 which attach to the sidewalls 44, 46 of the scroll cage 14. Again, the flanges 60, 62 are preferably affixed to the sidewalls 44, 46 to lessen the likelihood of vibratory noise, as by welding, adhesive, fasteners, or the like. Or flanges 60, 62 may be held on sidewalls 44, 46 by a deflection occurring in transition portions 56, 58. The front portions 52, 54 each include a hole 64, 66 extending therethrough which are exposed as shown in FIG. 1 for attaching the air deflectors 32, 34 to the ventilation duct (not shown) extending from the ventilator housing.

Figure 4:
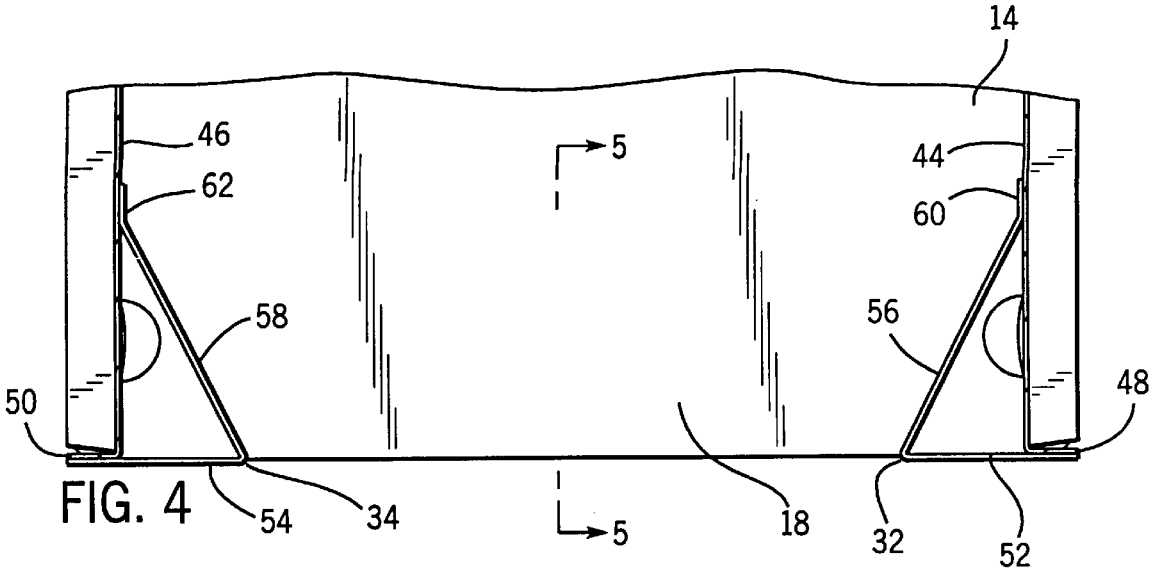
FIG. 4 is an enlarged view taken along line 4—4 of FIG. 2 of the air deflectors attached to the blower assembly outlet opening.

FIG. 4 shows a cross sectional view of the blower assembly outlet opening 18 with the air deflectors 32, 34 attached to the respective sidewalls 44, 46 of the scroll cage 14. The air deflectors 32, 34 are attached to the sidewall flanges 48, 50. FIG. 4 shows front portions 52, 54, transition portions 56, 58 extending rearwardly at an acute angle from the front portions, and flanges 60 extending rearwardly from the transition portions. The manner in which air deflectors 32, 34 decrease the width of the outlet opening 18 and provide a smooth air flow transition between the blower assembly outlet opening 18 and the ventilator housing outlet opening 30 is also shown in FIG. 4.

Figure 5:
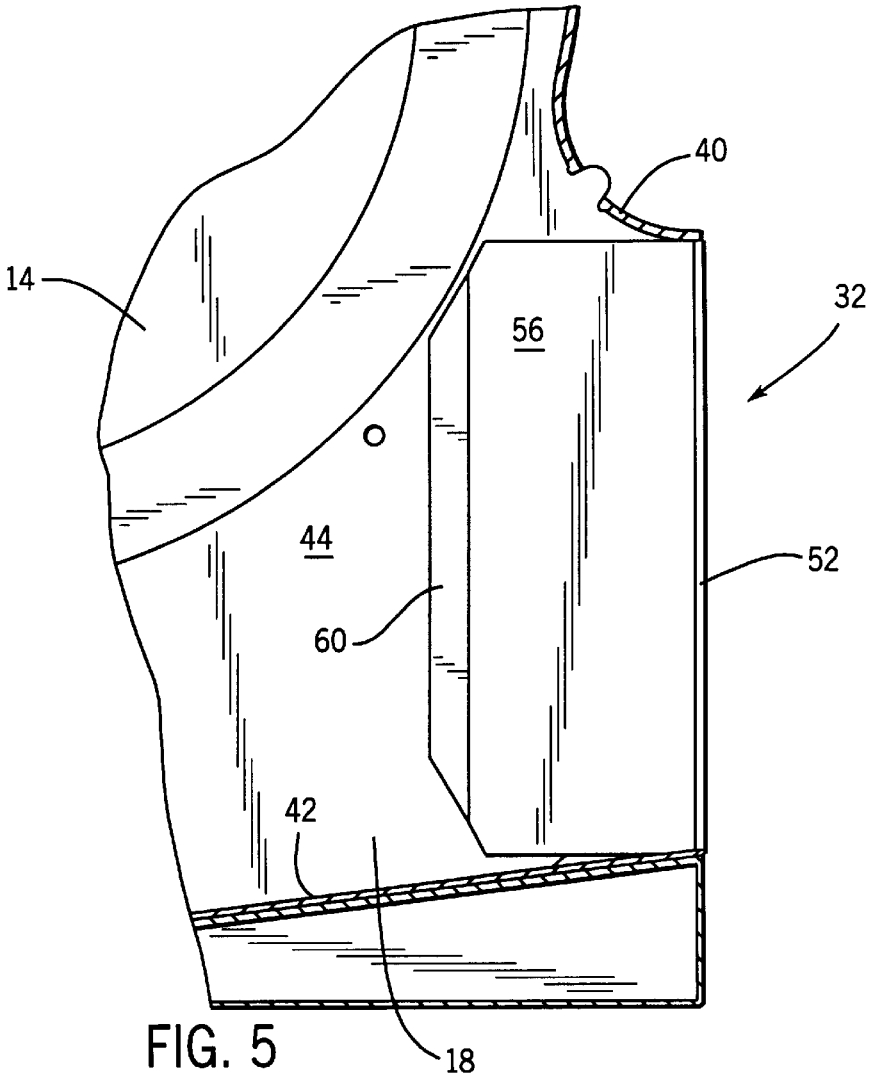
FIG. 5 is an enlarged view taken along line 5—5 of FIG. 4 of the air deflector which is attached to the right side of the blower assembly outlet opening when viewed as in FIG. 4.

FIG. 5 is a side view of the right side air deflector 32 attached to the right sidewall 44 of the scroll cage 14 shown in FIG. 4.

It is recognized that other equivalents, alternatives, and modifications aside from those expressly stated, are possible and within the scope of the appended claims.

We claim:

1. An air deflector assembly for use with a ventilator, the ventilator including a blower assembly with an air outlet opening of a given size and a ventilator housing for housing the blower assembly therein, the ventilator housing including an air outlet opening for mating with the air outlet opening of the blower assembly, the ventilator housing air outlet opening which is smaller than the blower assembly outlet opening, the air deflector assembly comprising:

a pair of air deflectors mountable in the air outlet opening of the blower assembly, each of said air deflectors having a front portion, a transition portion extending rearwardly at an angle from the front portion, the air deflectors being suitable for mounting in the air outlet opening of the blower assembly for reducing the size of the blower assembly air outlet opening to at least that of the ventilator housing air outlet opening for increasing air flow and decreasing turbulence in air exiting the blower assembly.

2. The air deflector assembly of claim 1 wherein the pair of air deflectors each include a flange extending rearwardly from the transition portion.

3. The air deflector assembly of claim 1 wherein the air deflectors are identical.

4. The air deflector assembly of claim 1 wherein the pair of air deflectors are affixed to the sides of the outlet opening, of the blower assembly.

5. The air deflector assembly of claim 1 wherein the pair of air deflectors decrease the width of the outlet opening, of the blower assembly to match the width of the outlet opening of the ventilator housing.

6. The air deflector assembly of claim 1 wherein the transition portion of the pair of air deflectors extends rearwardly at an acute angle from the front portion.

7. A blower assembly having an apparatus for increasing air flow and decreasing air turbulence in a ventilator, the ventilator including a ventilator housing for housing the blower assembly therein, the ventilator housing including an air outlet opening, the apparatus comprising:

a blower housing having an air outlet opening for mating with the air outlet opening of the ventilator housing; and a pair of air deflectors mounted to the air outlet opening of the blower housing, each of said air deflectors having a front portion, a transition portion extending rearwardly and at an angle from the front portion, the air deflectors reducing the size of the blower housing air outlet opening to at least that of the ventilator housing air outlet opening.

8. The apparatus of claim 7 wherein the pair of air deflectors each include a flange extending rearwardly from the transition portion.

9. The apparatus of claim 7 wherein the pair of air deflectors are identical.

10. The apparatus of claim 7 wherein the transition portion of the pair of air deflectors extends rearwardly at an acute angle from the front portion.

11. The apparatus of claim 7 wherein the pair of air deflectors decrease the width of the air outlet opening of the blower assembly to match the width of the air outlet opening in the ventilator housing.

* * * * *